US008193996B2

(12) United States Patent
Wu et al.

(10) Patent No.: US 8,193,996 B2
(45) Date of Patent: Jun. 5, 2012

(54) ANTENNA RADOME

(75) Inventors: Chun-Yih Wu, Taichung (TW); Hung-Hsuan Lin, Taipei (TW); Ken-Huang Lin, Kaohsiung (TW); Kun-Hsien Lin, Tainan County (TW); Yu-Feng Yeh, Taipei (TW)

(73) Assignees: Industrial Technology Research Institute, Hsinchu (TW); National Sun Yat-Sen University, Kaohsiung (TW)

( * ) Notice: Subject to any disclaimer, the term of this patent is extended or adjusted under 35 U.S.C. 154(b) by 531 days.

(21) Appl. No.: 12/335,585

(22) Filed: Dec. 16, 2008

(65) Prior Publication Data

US 2009/0315803 A1 Dec. 24, 2009

(30) Foreign Application Priority Data

Jun. 23, 2008 (TW) ..... 97123319 A

(51) Int. Cl.
*H01Q 1/42* (2006.01)

(52) U.S. Cl. ..... 343/872; 343/909; 343/700 MS

(58) Field of Classification Search ..... 343/909, 343/872, 873, 700 MS
See application file for complete search history.

(56) References Cited

U.S. PATENT DOCUMENTS

| | | | | |
|---|---|---|---|---|
| 6,791,432 | B2 | 9/2004 | Smith et al. | |
| 2006/0044189 | A1* | 3/2006 | Livingston et al. | 343/700 MS |
| 2006/0125681 | A1* | 6/2006 | Smith et al. | 342/120 |
| 2007/0107827 | A1 | 5/2007 | Takahashi et al. | |
| 2007/0109023 | A1 | 5/2007 | Beausoliel et al. | |
| 2007/0138402 | A1 | 6/2007 | Hyde et al. | |
| 2007/0146097 | A1 | 6/2007 | Lapin et al. | |
| 2007/0160096 | A1 | 7/2007 | Tanaka | |
| 2007/0176827 | A1 | 8/2007 | Itoh et al. | |
| 2007/0237478 | A1 | 10/2007 | D'Aguanno et al. | |
| 2007/0254455 | A1 | 11/2007 | Yamaguchi et al. | |
| 2007/0285315 | A1 | 12/2007 | Davis et al. | |
| 2007/0285324 | A1 | 12/2007 | Waterhouse et al. | |
| 2008/0001843 | A1 | 1/2008 | Wu et al. | |
| 2008/0013170 | A1 | 1/2008 | Tanaka | |
| 2008/0048917 | A1 | 2/2008 | Achour et al. | |
| 2008/0073647 | A1 | 3/2008 | Arasawa et al. | |
| 2008/0079638 | A1 | 4/2008 | Choi et al. | |
| 2008/0081298 | A1 | 4/2008 | Tanaka | |
| 2008/0094300 | A1 | 4/2008 | Lee | |
| 2008/0316140 | A1* | 12/2008 | Wu et al. | 343/872 |

OTHER PUBLICATIONS

"Planar High Gain Antenna for5.8-GHz WiMAX Operation" Chun-Yih Wu et al., Industrial Technology Research Institute, 2007 IEEE.
"Novel High Gain Metamaterial Antenna Radome for WiMAX Operation in the 5.8-GHz Band" Chun-Yih Wu et al., Industrial Technology Research Institute.
"Use of Conjugate Dielectric and Metamaterial Slabs as Radomes" H. Cory et al., Special Issue on Metamaterials LHM, IET Microw. Antennas Propag. 2007.

(Continued)

*Primary Examiner* — Dieu H Duong
(74) *Attorney, Agent, or Firm* — Thomas|Kayden

(57) ABSTRACT

An antenna radome is provided. The antenna radome comprises an antenna radome substrate and a unit cell. The unit cell is formed on a surface of the antenna radome substrate, and the unit cell is perpendicular to a magnetic field direction of an antenna. The unit cell comprises a plurality of conductors.

19 Claims, 6 Drawing Sheets

OTHER PUBLICATIONS

"A Novel Planar LHM Radome for Microstrip Antenna" Kun-Hsien Lin et al., IEEE 2008.

"Novel Thin Dual-band Frequency Selective Surface (FSS) Superstrate for Directivity Enhancement" Dong Hyun Lee et al., IEEE 2006.

Taiwanese language office action dated Sep. 9, 2011.

Carbonell, J., et al.; "Design and Experimental Verification of Backward-Wave Propagation in Periodic Waveguide Structures;" IEEE Transactions on Microwave Theory and Techniques; vol. 54; No. 4; Apr. 2006, pp. 1527-1533.

Chen, H.S., et al; "Left-Handed Materials Composed of Only S-Shaped Resonators" Phys. Rev. E.; vol. 70; 2004; pp. 1-2.

* cited by examiner

| The number of unit cells | 3 | 4 | 5 | 6 | 7 |
|---|---|---|---|---|---|
| The number of antenna radome substrates | 4 | 4 | 4 | 4 | 4 |
| The improvement of antenna gain (dB) | 4 | 4.7 | 5.2 | 5.8 | 6.3 |

ANTENNA RADOME

This application claims the benefit of Taiwan application Serial No. 97123319, filed Jun. 23, 2008, the subject matter of which is incorporated herein by reference.

BACKGROUND OF THE INVENTION

1. Field of the Invention

The invention relates in general to an antenna radome, and more particularly to an antenna radome capable of increasing the antenna gain and reducing the volume of an antenna system.

2. Description of the Related Art

An antenna of a front-end circuit is a necessary component in a wireless communication system. The property of the antenna significantly affects the signal quality of the whole system. Generally speaking, the received signal strength depends on the receiving power of the receiving terminal, the transmitting power of the transmitting terminal, the antenna gain of the transmitting antenna and the antenna gain of the receiving antenna. Therefore, the increase of the antenna gain improves the signal quality of the wireless communication system. Nowadays, an antenna array is used for increasing antenna gain. The antenna array increases the directivity of the antenna by increasing the number of antenna components, which improves the antenna gain.

However, the practical application of the antenna array enlarges the signal loss of the feeding network. As a result, the antenna gain can not be increased effectively. Furthermore, the antenna array enlarges the volume of the antenna and therefore is not suitable for a small base station.

SUMMARY OF THE INVENTION

The invention is directed to an antenna radome capable of effectively increasing the antenna gain and significantly reducing the volume of the antenna.

According to the present invention, an antenna radome is provided. The antenna radome includes an antenna radome substrate and a unit cell. The unit cell is formed on a surface of the antenna radome substrate and perpendicular to a magnetic field direction of an antenna.

According to the present invention, an antenna radome is provided. The antenna radome includes antenna radome substrates and unit cells. The antenna radome substrates overlap each other along a magnetic field direction of an antenna. The unit cells are formed on surfaces of the antenna radome substrates.

According to the present invention, an antenna radome is provided. The antenna radome includes an antenna radome substrate and a unit cell. The unit cell is formed on a surface of the antenna radome substrate. The unit cell includes first C-shaped conductors, second C-shaped conductors and third C-shaped conductors. The second C-shaped conductors are respectively adjacent to the first C-shaped conductors. The third C-shaped conductors are respectively positioned in openings of the second C-shaped conductors. Openings of the third C-shaped conductors are respectively opposite to the openings of the second C-shaped conductors.

The invention will become apparent from the following detailed description of the preferred but non-limiting embodiments. The following description is made with reference to the accompanying drawings.

DETAILED DESCRIPTION OF THE INVENTION

An antenna radome is provided in order to effectively increase the antenna gain and reduce the volume of an antenna. The antenna radome includes an antenna radome substrate and a unit cell. The unit cell is formed on a surface of the antenna radome substrate and perpendicular to a magnetic field direction of an antenna. The number of the antenna radome substrates and the unit cells can be adjusted flexibly according to the demands.

Figure 1:
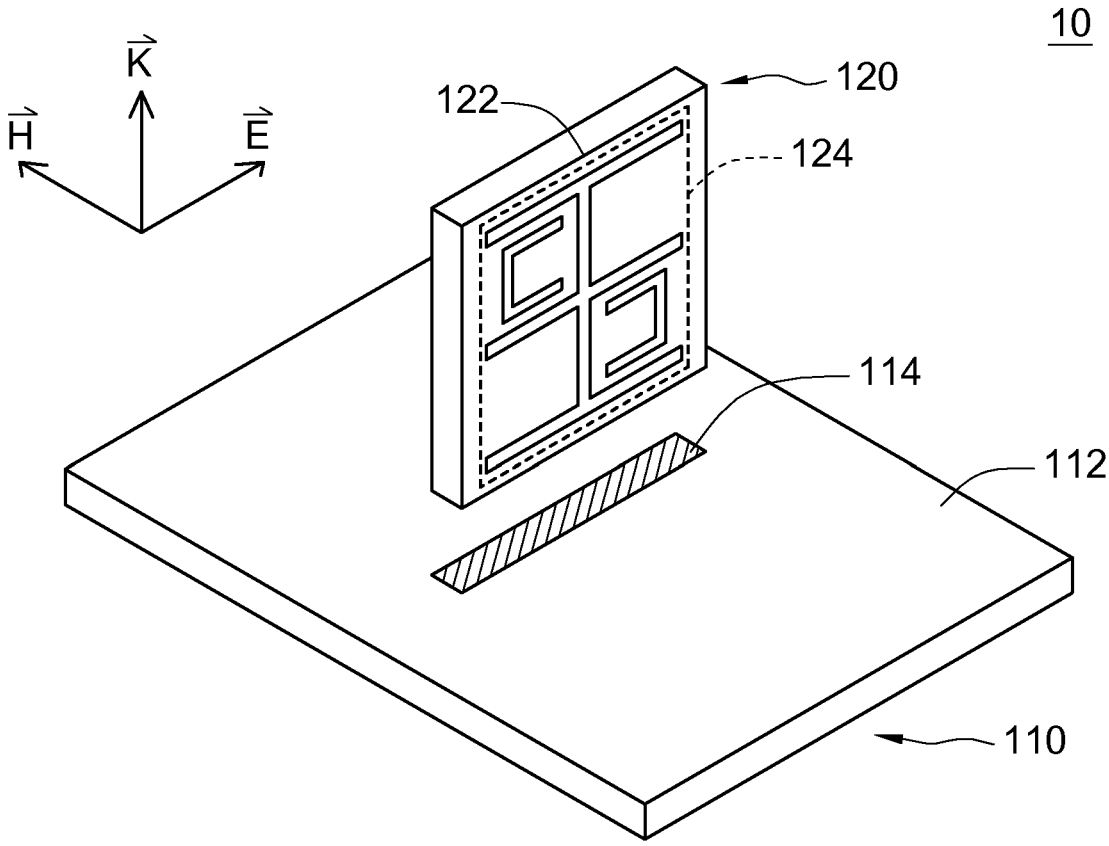
FIG. 1 is a three-dimensional view of an antenna system according to a first embodiment of the present invention.
Figure 2:
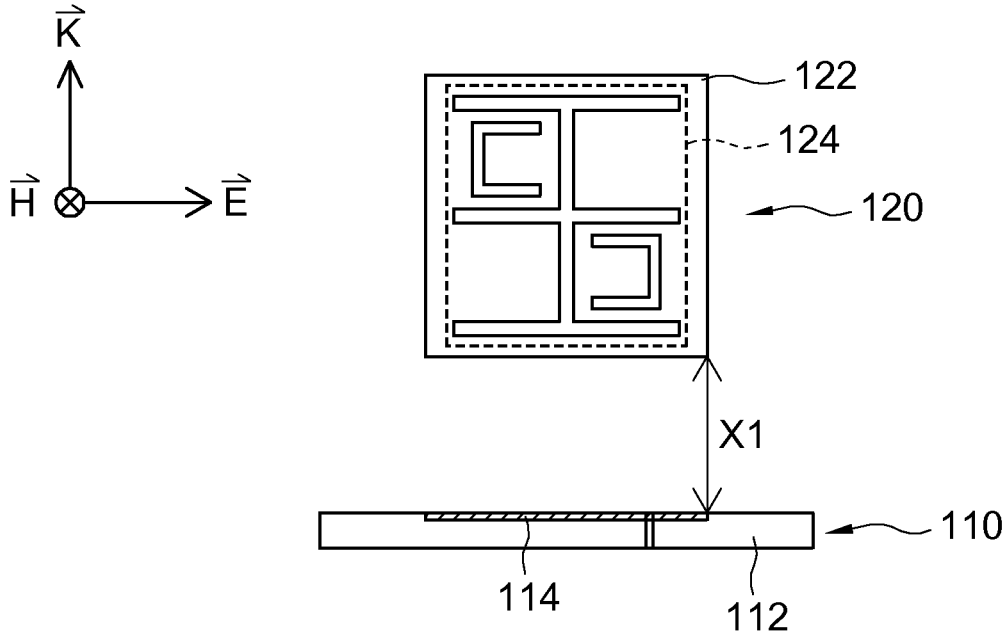
FIG. 2 is a side view of the antenna system according to the first embodiment of the present invention.
Figure 3:
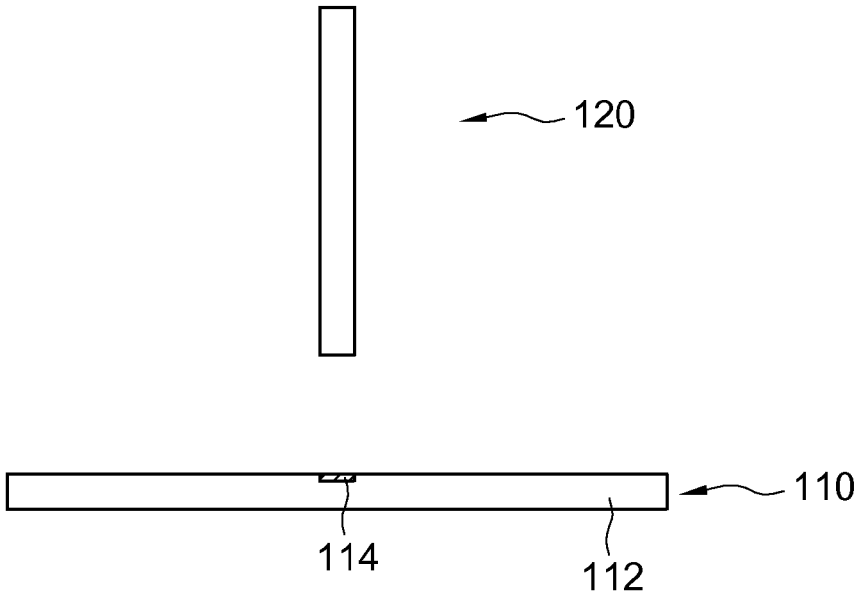
FIG. 3 is a front view of the antenna system according to the first embodiment of the present invention.

Please refer to FIG. 1, FIG. 2 and FIG. 3. FIG. 1 is a three-dimensional view of an antenna system according to a first embodiment of the present invention. FIG. 2 is a side view of the antenna system according to the first embodiment of the present invention. FIG. 3 is a front view of the antenna system according to the first embodiment of the present invention. The antenna system 10 includes an antenna 110 and an antenna radome 120. In the antenna system 10, a magnetic field direction $\vec{H}$, a radiation direction $\vec{K}$ and an electric field direction $\vec{E}$ are perpendicular to each other. The antenna 110 and the antenna radome 120 are apart at a specific distance x1. The specific distance x1 is decided according to the amount of coupling between the antenna 110 and the antenna radome 120.

The antenna 110 includes an antenna substrate 112 and a radiator 114. For example, the antenna 110 is a microstrip antenna, and the antenna substrate 112 is a FR4 substrate. The radiator 124 is formed on a surface of the antenna substrate 112, and the antenna radome 120 covers only the radiator 114.

The antenna radome 120 includes an antenna radome substrate 122 and a unit cell 124. The antenna radome substrate 122 is for example a Teflon substrate. The unit cell 124 is formed on a surface of the antenna radome substrate 122 and perpendicular to the magnetic field direction $\vec{H}$ of the antenna 110. The radiation wave emitted by the antenna 110 emits through the antenna radome 120 along the radiation direction $\vec{K}$, so that the antenna radome 120 effectively centralizes the radiation wave emitted by the antenna 110, which results in the increase of the antenna gain. The antenna system does not need to use a large antenna array to increase the antenna gain. Therefore, the volume of the antenna system 10 is significantly reduced. Furthermore, the unit cell 124 cuts the magnetic field, and the antenna radome 120 is apart from the antenna 110 at the specific distance x1. Accordingly, the frequency drift is reduced effectively.

Figure 4:
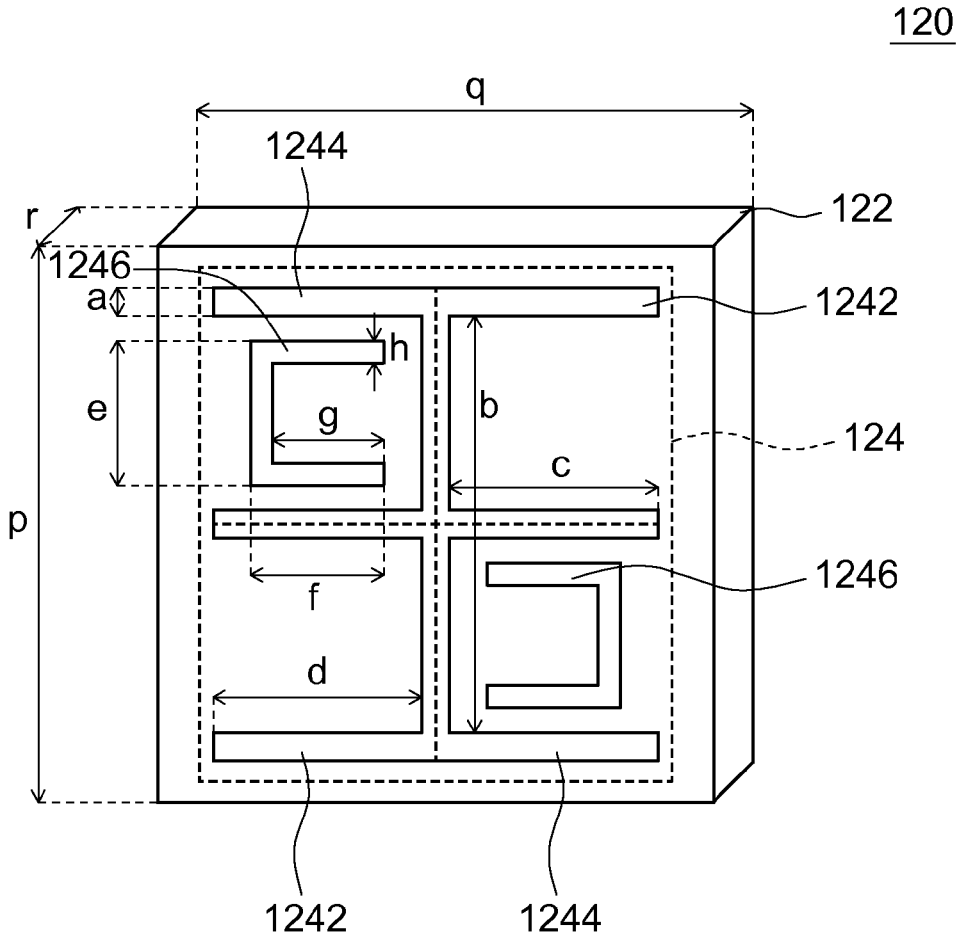
FIG. 4 is a three-dimensional view of an antenna radome.

Please refer to FIG. 4. FIG. 4 is a three-dimensional view of the antenna radome. In order to illustrate the present embodiment more clearly, the unit cell in FIG. 4 is described as an example of the present invention. However, the invention is not limited thereto. Anyone who has ordinary skill in the field of the invention can understand that the design of the unit cell can be changed according to the application without departing from the spirit of the invention.

Furthermore, the unit cell 124 includes C-shaped conductors 1242, 1244 and 1246. The C-shaped conductors 1244 are adjacent to the C-shaped conductors 1242. The C-shaped conductors 1246 are positioned in the openings of the C-shaped conductors 1244. The C-shaped conductor 1242 and the C-shaped conductor 1244 respectively have angles $\alpha$ and $\beta$. In FIG. 4, the angles $\alpha$ and $\beta$ are substantially equal to 90°.

In FIG. 4, the sizes p, q, and r of the antenna radome substrate 122 are respectively 19.2 mm, 19.2 mm and 1.6 mm as an example. The sizes a, b, c, d, e, f, g, h are respectively 0.014λ, 0.175λ, 0.093λ, 0.086λ, 0.056λ, 0.07λ, 0.053λ and 0.014λ. The wavelength of the radio wave is expressed by $\lambda=c/f$ (λ: wavelength, c: speed of light in a vacuum, and f: operating frequency).

However, the above sizes are described as an example. Anyone who has ordinary skill in the present invention can change the size and shape of the unit cell 122 according to the application without departing from the spirit of the invention.

Figure 5:
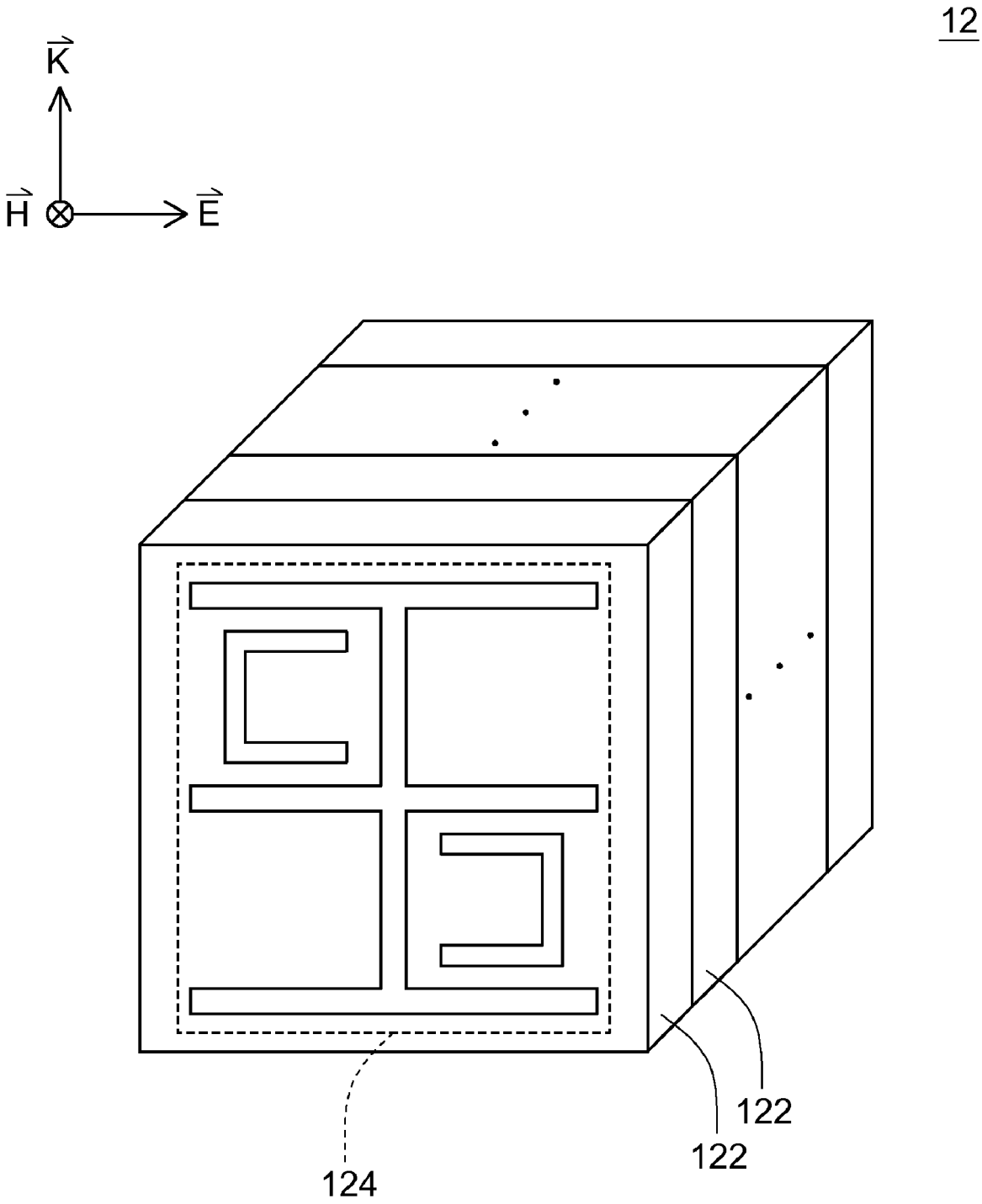
FIG. 5 is a three-dimensional view of a cubic antenna radome.

Please refer to FIG. 5. FIG. 5 is a three-dimensional view of a cubic antenna radome. In the antenna radome 120, only a cell unit 124 is formed on the antenna radome substrate 122 as an example. However, the invention is not limited thereto. For example, the cubic antenna radome 12 in FIG. 5 includes several unit cells 124 and several antenna radome substrates 122. The cell units 124 are respectively formed on the surfaces of the antenna radome substrates 122. The antenna radome substrates 122 overlap each other to form the cubic antenna radome 12. The cubic antenna radomes 12 can further be manufactured in modules. Therefore, the user can arrange or stack several cubic antenna radomes 12 periodically along the radiation direction $\vec{K}$ according to the demand of the antenna gain for achieving the best effects to meet the customized needs.

Figure 6:
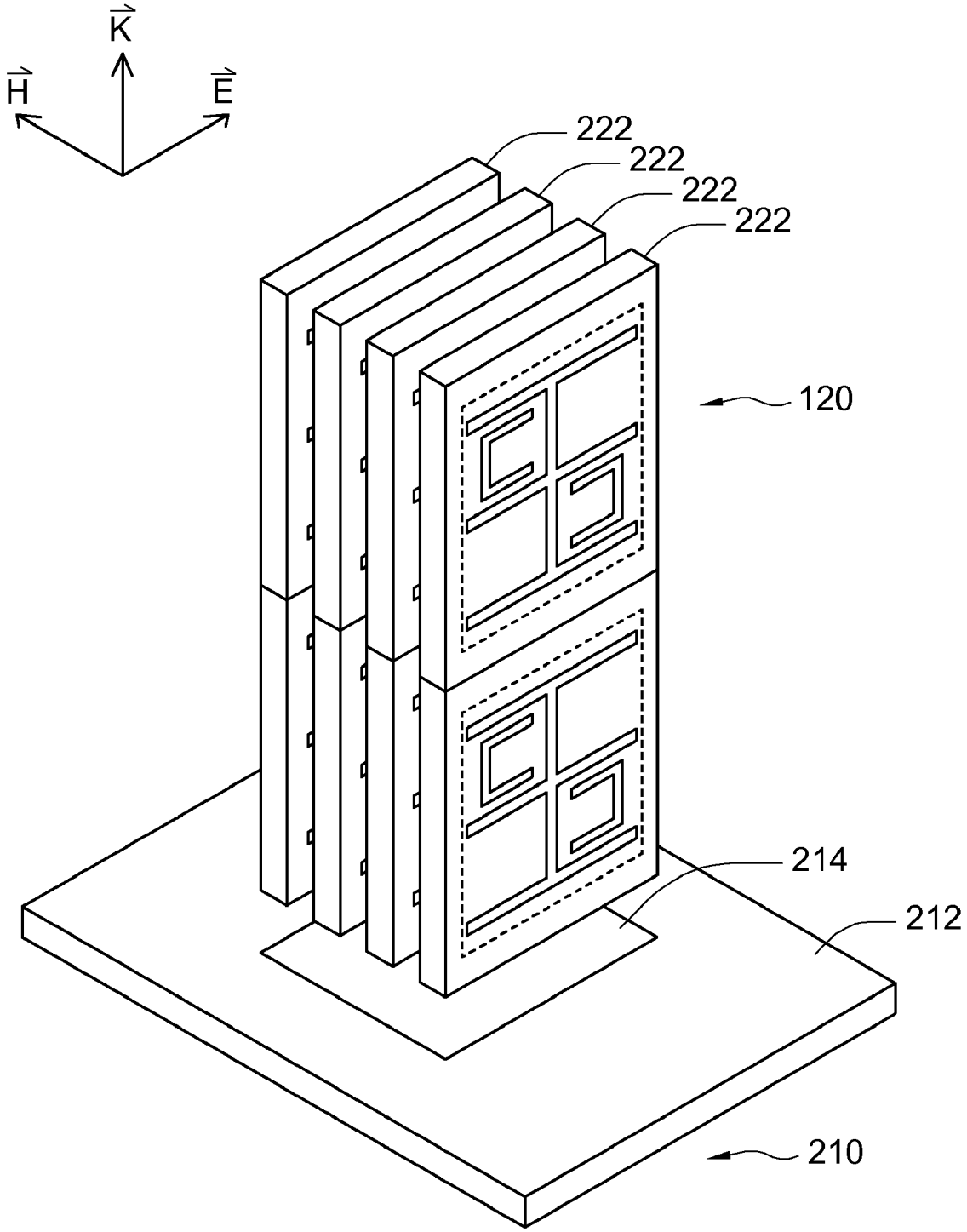
FIG. 6 is a three-dimensional view of the antenna system according to a second embodiment of the present invention.
Figure 7:
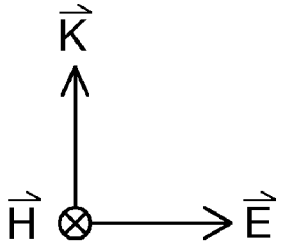
FIG. 7 is a side view of the antenna system according to the second embodiment of the present invention.
Figure 7:
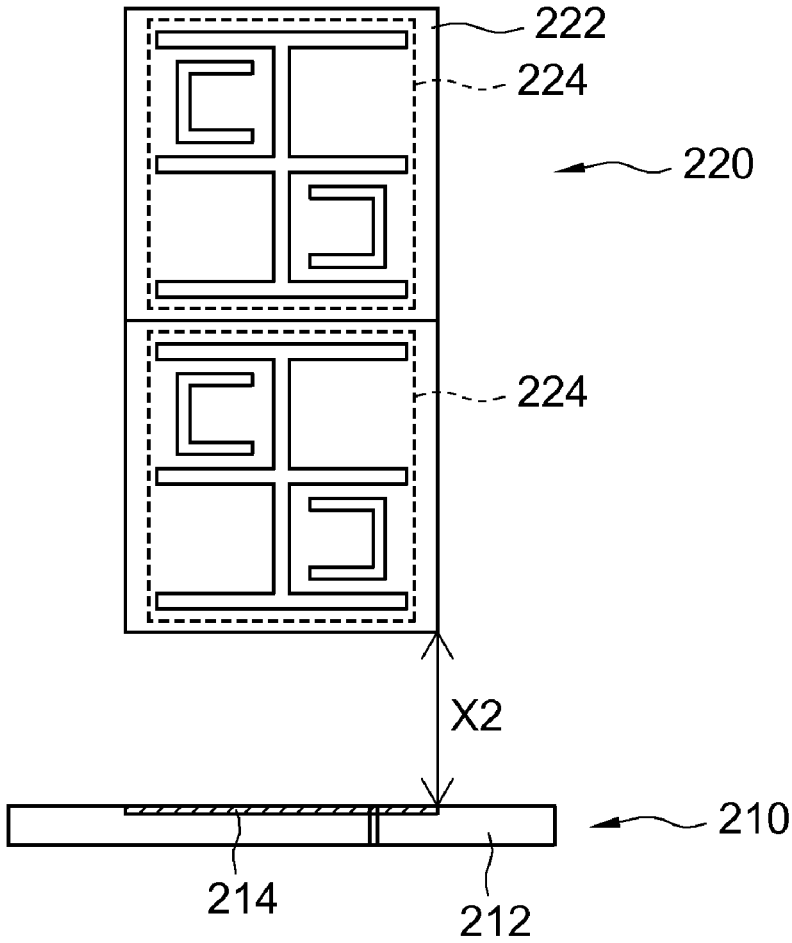
Figures 8, 9:
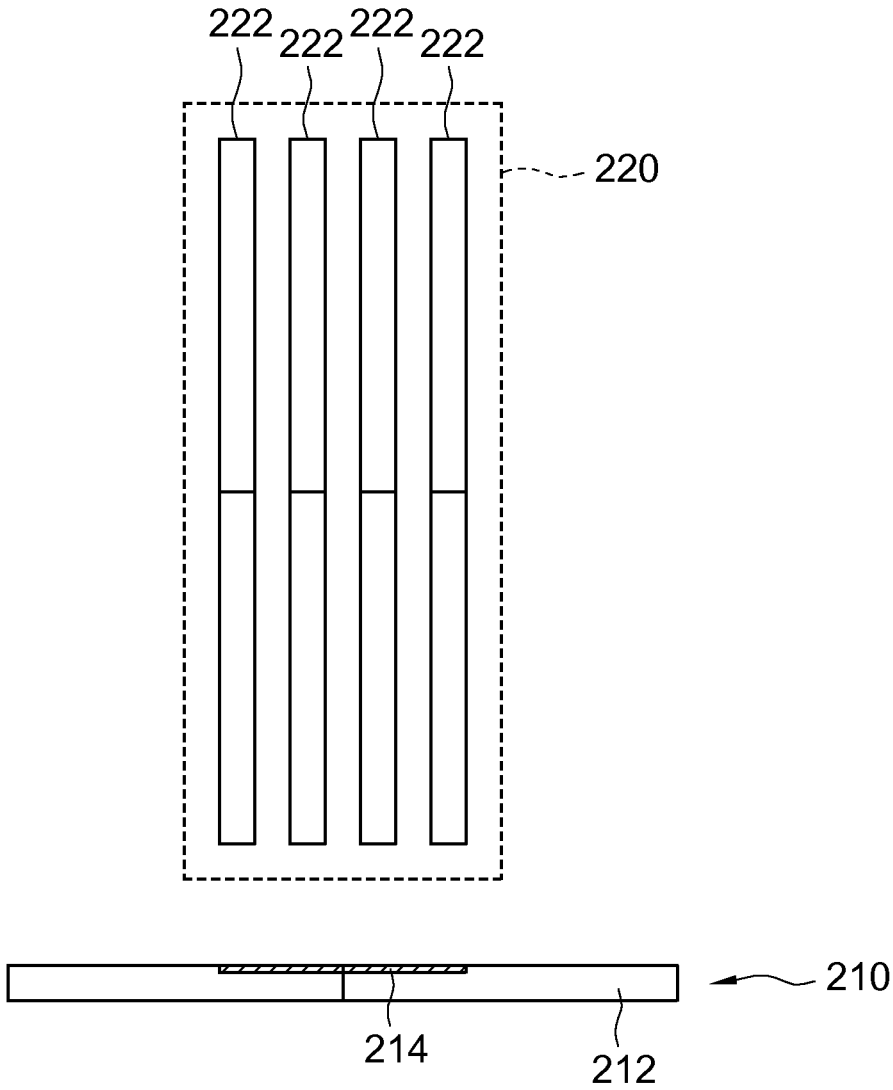
FIG. 8 is a front view of the antenna system according to the second embodiment of the present invention.
FIG. 9 is a table showing the corresponding relation between the number of antenna radome substrates and unit cells and the improvement of the antenna gain.

Please refer to FIG. 6, FIG. 7 and FIG. 8 at the same time. FIG. 6 is a three-dimensional view of the antenna system according to a second embodiment of the present invention. FIG. 7 is a side view of the antenna system according to the second embodiment of the present invention. FIG. 8 is a front view of the antenna system according to the second embodiment of the present invention. In the above-described antenna radome 120, only one unit cell is used for forming the antenna radome substrate 122 as an example. However, the present invention is not limited thereto. For example, the antenna radome 220 in FIG. 6, FIG. 7 and FIG. 8 includes four antenna radome substrates 222. Two unit cells 224 are formed on the surface of each antenna radome substrate 222 and arranged periodically along the radiation direction $\vec{K}$.

The antenna 210 and the antenna radome 220 are apart at a specific distance x2. The specific distance x2 is decided according to the amount of coupling between the antenna 210 and the antenna radome 220. In the present embodiment, the specific distance x2 is equal to 0.1λ. The antenna 210 includes the antenna substrate 212 and the radiator 214. The radiator 224 is formed on the surface of the antenna substrate 212, and the antenna radome 220 only covers the radiator 214.

Please refer to FIG. 9. FIG. 9 is a table showing the corresponding relation between the number of the antenna radome substrates and the unit cells and the improvement of the antenna gain. As stated above, the number of the antenna radome substrates and the unit cells can be adjusted according to the application demands. When the number of the antenna radome substrate is 4 and three unit cells are formed on the antenna radome substrate, the improvement of the antenna gain us 4 dB. Moreover, when the number of the antenna radome substrates remains at 4 and the number of the unit cells formed on the antenna radome substrate is respectively 4, 5, 6 and 7, the improvement of the antenna gain is respectively 4.7 dB, 5.2 dB, 5.8 dB and 6.3 dB.

The antenna radome disclosed in the above embodiments includes at least following advantages.

First, the antenna gain is increased.

Second, the volume of the antenna system is reduced.

Third, the frequency drift is reduced.

Fourth, when the antenna radomes are manufactured in modules as cubic antenna radomes, the user can stack several cubic antenna radomes according to the demands of the antenna gain for achieving the best effects to meet the customized needs.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna radome comprising:

an antenna radome substrate; and a unit cell formed on a surface of the antenna radome substrate and perpendicular to a magnetic field direction of an antenna;

wherein the antenna radome and the antenna are apart at a specific distance which is 0.1λ.

2. The antenna radome according to claim 1 further comprising other N antenna radome substrates overlapping the antenna radome substrate, wherein N is a positive integer.

3. The antenna radome according to claim 2, wherein the other N antenna radome substrates and the antenna radome substrate overlap each other along the magnetic field direction of the antenna to form a cubic antenna radome.

4. The antenna radome according to claim 3, wherein the cubic antenna radome and other M cubic antenna radomes are arranged periodically along a radiation direction of the antenna, M being a positive integer.

5. The antenna radome according to claim 1, wherein the antenna comprises:

an antenna substrate; and a radiator, formed on a surface of the antenna substrate, the antenna radome substantially covering only the radiator.

6. The antenna radome according to claim 1, wherein the unit cell comprises:

a plurality of first C-shaped conductors;

a plurality of second C-shaped conductors, respectively adjacent to the first C-shaped conductors; and a plurality of third C-shaped conductors, respectively positioned in openings of the second C-shaped conductors, openings of the third C-shaped conductors opposite to the openings of the second C-shaped conductors.

7. The antenna radome according to claim 6, wherein the first C-shaped conductors respectively have an angle substantially equal to 90°.

8. The antenna radome according to claim 6, wherein the second C-shaped conductors respectively have an angle substantially equal to 90°.

9. An antenna radome comprising:

a plurality of antenna radome substrates, overlapping each other along a magnetic field direction of an antenna; and a plurality of unit cells, formed on surfaces of the antenna radome substrates, and perpendicular to the magnetic field direction of the antenna;

wherein the antenna radome is apart from the antenna at a specific distance which is 0.1λ.

10. The antenna radome according to claim 9, wherein the antenna radome is a cubic antenna radome.

11. The antenna radome according to claim 10, wherein the cubic antenna radome and other M cubic antenna radome are arranged periodically along a radiation direction of the antenna, M being a positive integer.

12. The antenna radome according to claim 9, wherein the antenna comprises:

an antenna substrate; and a radiator, formed on a surface of the antenna substrate, the antenna radome substantially covering only the radiator.

13. The antenna radome according to claim 9, wherein unit cells are arranged periodically along a radiation direction of the antenna.

14. The antenna radome according to claim 9, wherein each unit cell comprises:

a plurality of first C-shaped conductors;

a plurality of second C-shaped conductors, respectively adjacent to the first C-shaped conductors; and a plurality of third C-shaped conductors, respectively positioned in openings of the second C-shaped conductors, opening of the third C-shaped conductors opposite to the openings of the second C-shaped conductors.

15. The antenna radome according to claim 14, wherein the first C-shaped conductors respectively have an angle substantially equal to 90°.

16. The antenna radome according to claim 14, wherein the second C-shaped conductors respectively have an angle substantially equal to 90°.

17. An antenna radome comprising:

an antenna radome substrate; and a unit cell, formed on a surface of the antenna radome substrate and comprising:

a plurality of first C-shaped conductors;

a plurality of second C-shaped conductors, respectively adjacent to the first C-shaped conductors; and a plurality of third C-shaped conductors, respectively positioned in openings of the second C-shaped conductors, opening of the third C-shaped conductors opposite to the openings of the second C-shaped conductors;

wherein the antenna radome is apart from an antenna at a specific distance which is 0.1λ.

18. The antenna radome according to claim 17, wherein the first C-shaped conductors respectively have an angle substantially equal to 90°.

19. The antenna radome according to claim 17, wherein the second C-shaped conductors respectively have an angle substantially equal to 90°.

* * * * *